US005308266A

United States Patent [19]

Booker

[11] Patent Number: 5,308,266

[45] Date of Patent: May 3, 1994

[54] UNIVERSAL ELECTRICAL SOCKET APPARATUS

[75] Inventor: Philip H. Booker, Lake Forest, Calif.

[73] Assignee: Tronomed, Inc., San Juan Capistrano, Calif.

[21] Appl. No.: 1,169

[22] Filed: Jan. 7, 1993

[51] Int. Cl.[5] ..... H01R 13/00

[52] U.S. Cl. ..... 439/817

[58] Field of Search ..... 439/842–850, 439/840, 841, 668, 669, 685, 686, 817–821, 823

[56] References Cited

U.S. PATENT DOCUMENTS

| | | | |
|---|---|---|---|
| 1,061,809 | 5/1913 | Boorselski et al. . | |
| 1,559,683 | 11/1925 | Douglas . | |
| 1,812,307 | 6/1931 | Schneider . | |
| 1,943,590 | 1/1934 | Douglas . | |
| 2,164,200 | 6/1938 | Douglas . | |
| 2,189,714 | 2/1938 | Hilado . | |
| 2,225,012 | 4/1938 | Douglas . | |
| 2,424,444 | 7/1947 | Fox . | |
| 3,478,304 | 11/1969 | Valle . | |
| 3,536,870 | 10/1970 | Izumi | 439/668 |
| 3,649,948 | 3/1972 | Porter | 439/669 |
| 3,806,860 | 4/1974 | Flammini . | |
| 3,989,345 | 11/1976 | De Vito . | |

FOREIGN PATENT DOCUMENTS

| | | | |
|---|---|---|---|
| 1074693 | 2/1960 | Fed. Rep. of Germany . | |
| 547552 | 3/1923 | France . | |
| 0083951 | 6/1920 | Switzerland | 439/818 |
| 727380 | 3/1955 | United Kingdom . | |

*Primary Examiner*—Joseph H. McGlynn
*Attorney, Agent, or Firm*—Price, Gess & Ubell

[57] ABSTRACT

A socket apparatus, within which conductive terminals can be secured and electrically connected as desired, comprising of a housing member, lid, and means for securing conductive terminals within the housing member. The socket apparatus includes an aperture that is specifically designed to accommodate conductive terminals varying in size and in variety. Furthermore, the socket apparatus' lid supports the means for securing the conductive terminals.

18 Claims, 2 Drawing Sheets

UNIVERSAL ELECTRICAL SOCKET APPARATUS

BACKGROUND OF THE INVENTION

1. Field of the Invention

The present invention relates to a universal electrical socket and, more particularly, to a medical socket apparatus that is capable of securing conductive terminals of various sizes.

2. Description of Related Art

Universal electrical sockets are often comprised of numerous parts, thus making assembly of the sockets difficult, time-consuming, and expensive. Another limitation is that they are designed only to accommodate conductive terminals of a particular size.

Representative prior art in the field of electrical connectors includes U.S. Pat. No. 1,061,809, disclosing a binding post with an opening into which a conductive wire is inserted and secured.

U.S. Pat. No. 1,559,683 teaches that an electrical connector can secure a conductive terminal within its housing by utilizing a spring.

U.S. Pat. No. 1,943,590 discloses an electrical connector that has a triangular shaped opening for receiving conductive terminals.

U.S. Pat. Nos. 2,010,453, 2,115,012, and 2,164,200, and French Patent No. 25,906 disclose electrical connectors that use a spring to secure conductive terminals. Other electrical connectors that contain a spring are also disclosed in German Patent No. 1,074,693 and in English Patent No. 727,380.

Finally, U.S. Pat. No. 2,424,444 discloses an electrical binding post that can secure wires that vary in diameter.

The prior art is still seeking to provide a simplified universal electrical connector.

SUMMARY OF THE INVENTION

The universal electrical socket apparatus of the present invention provides a housing member within which various sized conductive terminals can be secured and electrically connected as desired. The housing has a cavity which mounts a spring, a contact pressure slide, and a conductive contact. A lid, which is also part of the socket apparatus, covers an opening of the cavity and supports the spring, contact pressure slide, and conductive contact. When conductive terminals are inserted into the housing member's opening, they are secured between the contact pressure slide and the conductive contact by the spring. The desired electrical connection is made via a conductive wire that is attached to the conductive contact.

The universal socket is easily and inexpensively assembled because it consists of only a few parts. Also, the socket apparatus provides an aperture that is specifically designed to accommodate cylindrical conductive terminals of varying diameters, as well as "banana-type" conductive terminals of varying diameters that can compress to become cylindrical when inserted.

An objective of the present invention is to provide an universal electrical socket apparatus that consists of only a few parts that are easily and inexpensively assembled and then inserted into an opening on the housing member and held therein by a lid.

Another objective of the present invention is to provide an universal electrical socket apparatus that has an aperture that is specifically designed to accommodate conductive terminals of varying diameters, as well as "banana-type" conductive terminals of varying diameters that compress to become cylindrical when inserted.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a universal socket that is characterized by the features and advantages described below.

Figures 1, 2, 3, 7:
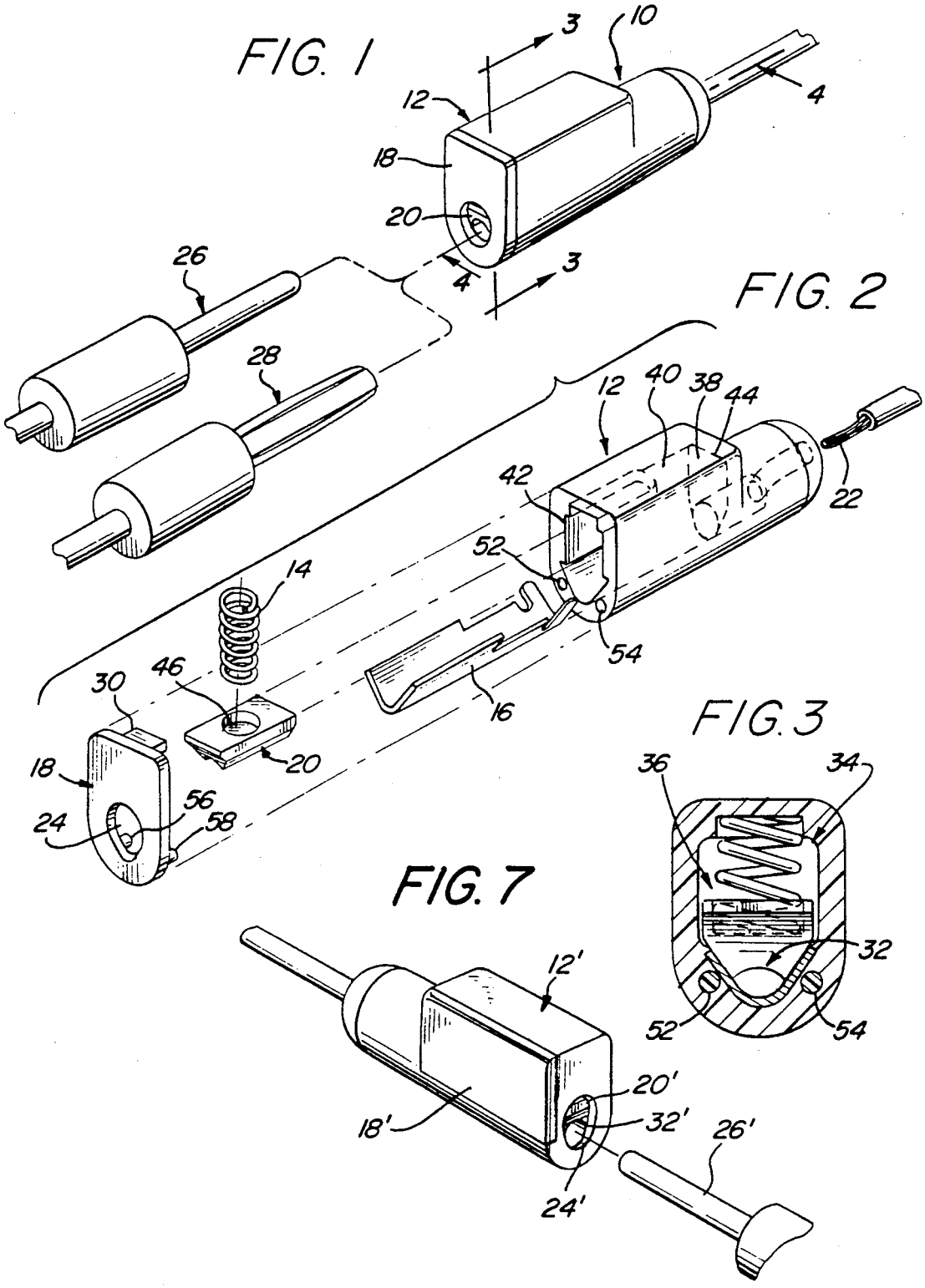
FIG. 1 is a schematic perspective showing a preferred embodiment of the universal electrical socket apparatus, and further illustrating two different conductive terminals, either of which, alone, the socket apparatus is designed to accommodate.
FIG. 2 is an exploded perspective of the socket apparatus shown in FIG. 1.
FIG. 3 is a front view of the socket apparatus shown in FIG. 1 without the lid.
FIG. 7 is schematic perspective showing an alternative embodiment of the socket apparatus.

FIG. 1 shows a preferred embodiment of an universal electrical socket apparatus 10 according to the present invention. FIG. 2 illustrates an exploded view of such a socket apparatus which comprises a molded housing member 12, a spring 14, a conductive contact 16, a lid member 18, a contact pressure slide member 20, and a conductive wire 22. The lid 18 further includes an oblong aperture 24 through which conductive terminals 26 and 28 of different sizes may be inserted into the housing 12. As shown in FIG. 1, conductive terminals 26 are typically cylindrical. Additionally, the shape and size of the aperture 24 also allows it to accommodate "banana-type" plugs 28. Such plugs may be described as conductive terminals of varying diameters that are capable of being compressed into a cylindrical shape.

Conductive terminals 26 and "banana-type" plugs 28 are typical of conductive terminals that are used in the medical instrumentation field. Such conductive terminals vary in size and shape. Accordingly, the sockets that receive them must also vary in size and shape. Sometimes, medical personnel inadvertently insert a conductive terminal into a socket that is not designed to receive it. Often the socket is irreparably damaged by this action. The contemplated invention solves this problem by providing a universal electrical socket apparatus that accommodates conductive terminals that vary in size and shape.

The aforementioned conductive terminals 26 and "banana-type" plugs 28, when inserted through the aperture 24, enter the housing 12 and contact the pressure slide member 20. The spring 14, contact pressure slide member 20, and conductive contact 16, collectively, serve as an embodiment of a means for securing conductive terminals 26 or "banana-type" plugs 28 within the housing member 12.

The conductive contact 16, which is electrically connected to a conductive wire 22, is also mounted within the housing 12. Spring 14 and contact pressure slide 20 can be held within the housing member 12 by the lid member 18. This arrangement can facilitate production time savings. One advantage of the socket apparatus 10 is that the lid 18 is shaped such that it supports the means for securing conductive terminals within the housing member 12. More specifically, the spring 14 and contact pressure slide member 20 are aligned and supported by the lid 18 in cooperation with the stepped cavity of the housing member 12.

Figure 4:
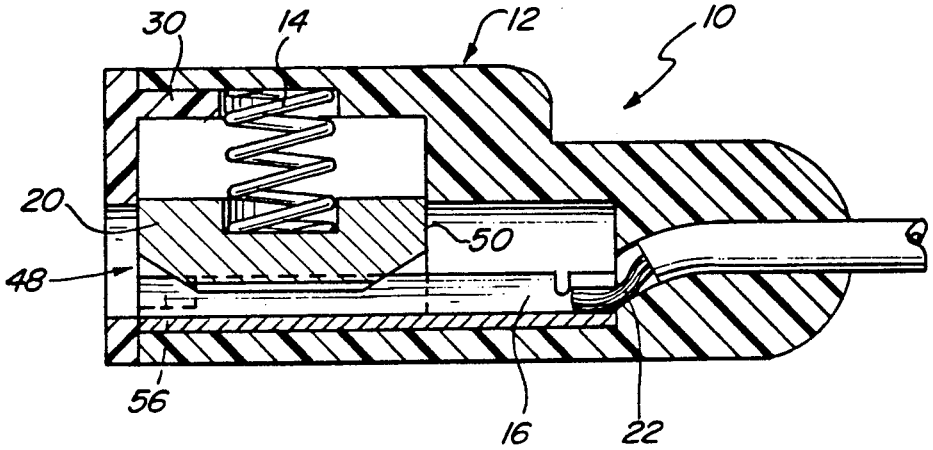
FIG. 4 is a partial cross-sectional side view of the socket apparatus shown in FIG. 1.

FIG. 4 illustrates a cross-sectional view of an embodiment of the invention wherein the lid 18 includes an integrated tab 30. The tab 30 can be functionally fitted into the housing 12, thereby securing the lid 18 to the housing 12. Alternatively, a medical grade adhesive can be used to secure the lid 18 to the housing 12. Furthermore, the tab 30 supports and positions the upper side of the spring 14.

The manner in which the universal electrical socket apparatus 10 is assembled also distinguishes it from the prior art. The inside of the housing 12 contains a channel that is specifically dimensioned so that the spring 14 can be inserted into the channel. After the spring 14 is inserted, then the lid 18 is secured to the socket apparatus 10 by guiding tab 30 cantilevered from lid 18 into the channel. In summary, the walls of this channel and the end of the tab 30 work together to support the sides of the spring 14 after it is assembled into the housing member 12.

The contact pressure slide 20 can be functionally attached to one end of the spring 14. Generally, the contact pressure slide 20 moves transversely to the axis of the aperture opening within the housing 12 and thereby secures any inserted conductive terminals 26 and "banana-type" plugs 28 to the lower conductive contact 16.

FIG. 3 shows a beveled surface 32 on the contact pressure slide 20. When inserted through the aperture 24 and into the housing 12, conductive terminals 26 and "banana-type" plugs 28 first make contact with the beveled surface 32. In response to such contact, the contact pressure slide 20 moves transversely within the housing member 12. Since spring 14 is attached to the contact pressure slide 20, such movement results in the compression of the spring 14. The spring 14 applies a counter-force to the contact pressure slide 20. This counter-force, in turn, by virtue of the fact that the contact pressure slide 20 is attached to the spring 14, is applied to the contact pressure slide 20 to exert a securing force against the conductive terminals 26 and "banana-type" plugs 28 to ensure a positive contact with the conductive contact 16.

A preferred embodiment of the contemplated invention has a housing member 12 that is molded. In many cases, prior art electrical sockets were formed by the wasteful cutting of sheet metal into multisided pieces suitable for subsequent bending into three-dimensional socket apparatuses. The contemplated invention's molded housing structure is clearly an improvement over such prior art because it does not require a complicated assembly.

FIG. 3 shows the preferred embodiment's housing member 12 with a surface 34 including a recess 36. As can be seen in FIG. 2, recess 36 essentially forms a hollow area within the housing 12 that ends at a base 38. Recess 36 is, in its entirety, bounded by base 38 and adjoining inside wall 40.

Inside wall 40 is particularly characterized by its stepped contours. For example, inside wall 40 includes two downward-facing ridges under which conductive contact 16 snugly fits during assembly of socket apparatus 10. Additionally, the top of inside wall 40 is contoured such that it forms a channel. This channel might be described as a planar region bordered on both its left and right sides by two opposed, inward-facing ridges. These opposed, inward-facing ridges are designed to support the sides of spring 14 during assembly of socket apparatus 10.

In other words, when the socket apparatus 10 is being assembled, conductive contact 16 is inserted into the recess 36 and is held against inside wall 40 because of the aforementioned, downward-facing ridges on inside wall 40. Similarly and as is seen in FIG. 3, spring 14 slides into recess 36 with one end of spring 14 being supported on its sides by the two opposed, inward-facing ridges discussed in the preceding paragraph. Another distinguishing feature of the contemplated invention, as illustrated in FIG. 2, is that lid 18 and its tab 30, in conjunction with the contours of the inside wall 40, provide an elegant and integrated solution to the problem of quickly and easily assembling spring 14 into the socket apparatus 10.

The following is a more detailed description of how the boundary of recess 36 is formed by base 38 and inside wall 40. Inside wall 40 spans from the recess' perimeter 42 on surface 34 and ends at the base's perimeter 44. As shown in FIG. 3, one end of spring 14, as well as conductive contact 16, are supported by inside wall 40.

Figure 5:
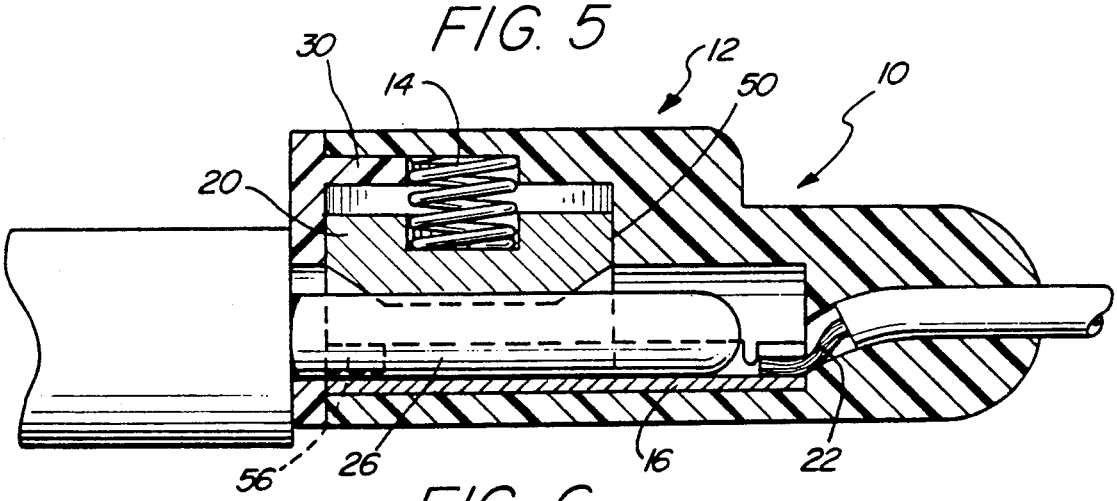
FIG. 5 is the socket apparatus shown in FIG. 4 with a conductive terminal inserted therein.
Figure 6:
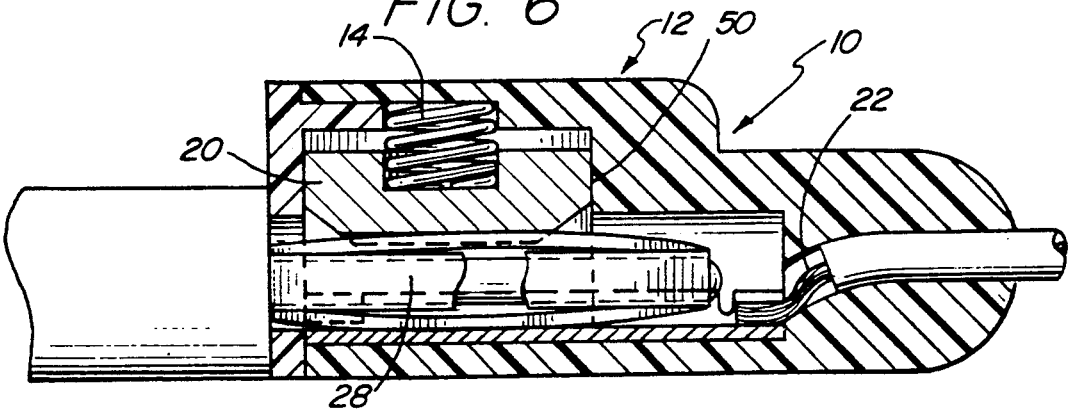
FIG. 6 is the socket apparatus shown in FIG. 4 with a different conductive terminal inserted therein.

FIG. 4 shows that the above-described preferred embodiment is further comprised of a contact pressure slide 20 that contains a beveled surface 32 facing aperture 24 on lid 18. The contact pressure slide 20 moves transversely within the recess 36 when conductive terminals 26 and "banana-type" plugs 28 are inserted through the aperture 24 and make contact with the beveled surface 32. Compressed between the inside wall 40 and the contact pressure slide 20 is the spring 14. When the spring is compressed by insertion of conductive terminals 26, it exerts a counter-force. Since the spring 14 is attached to the contact pressure slide 20, as is seen in FIG. 5, this counter-force, in turn, secures inserted conductive terminals 26 between the contact pressure slide 20 and the conductive contact 16. As FIG. 6 illustrates, a "banana-type" plug can be similarly secured within the recess 36.

The contact pressure slide 20, in the preferred embodiment shown in FIG. 2, contains a depression 46 within which sits the spring 14. The depression 46 is centrally located within the contact pressure slide 20 to better facilitate transverse movement of the contact pressure slide 20 within the recess 36. Furthermore, as is seen in FIG. 4, this contact pressure slide 20 has a back end 48 and a front end 50 which slide against the lid 18 and the base 38, respectively.

FIG. 3 shows a surface 34 that has a recess 36, as well as a first additional recess 52 and a second additional recess 54. FIG. 2 shows a lid 18 which includes a tab 30, as well as a first additional tab 56 and a second additional tab 58. Such a lid 18 is secured against surface 34 by fitting tab 30, first additional tab 56, and second additional tab 58 into recess 36, first additional recess 52, and second additional recess 54, respectively. Lid 18 with three tabs is merely a preferred embodiment and in no way should be interpreted as a limitation on the contemplated invention. Affirmatively stated, the universal electrical socket apparatus contemplates any numbers of tabs or similar means by which lid 18 may be secured to housing member 12.

FIG. 4 shows how easily the contact pressure slide 20 and spring 14 can be attached together and then inserted into recess 36. First, spring 14 is inserted into depression 46 on the contact pressure slide 20. Second, spring 14 and contact pressure slide 20, attached to each other as described above, are inserted into recess 36 such that the end of the spring 14 is supported by the inside wall 40. Third, lid 18 is secured to surface 34 as described in the previous paragraph. Lid 18 is specifically designed so that its tab 30 will support the side of the spring 14 when lid 18 is secured to surface 34.

The particular combination described above is merely one embodiment of the contemplated invention. An additional embodiment is illustrated in FIG. 7. This embodiment differs significantly from the embodiment in FIG. 1 only in that the aperture 24' is located on the housing member 12' rather than carried on the lid 18'.

The contemplated invention is clearly an improvement over the prior art and advantageous in that it consists of only a few parts that can be quickly, easily, inexpensively, and reliably assembled. Also, the means for securing conductive terminals within the housing member 12 and the lid 18 are specifically designed to accommodate cylindrical conductive terminals 26 of varying diameters and conductive terminals of varying diameters that compress to become cylindrical (e.g., "banana-type" plugs 28). Furthermore, the functional interrelation between the housing member 12, means for securing conductive terminals within the housing, and lid 18 particularly distinguishes the contemplated invention from the prior art.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A socket apparatus including:

a housing member with a stepped cavity defining a channel within the housing member;

a conductive contact within the housing member;

means for securing a conductive terminal within the housing member against the conductive contact, the securing means being positioned within the channel; and a lid attached tot he housing member, the lid including a guiding tab sized to fit within the channel such that the guiding tab and the channel mutually support the securing means within the housing member, wherein one of the housing member and the lid contains an aperture through which the conductive terminal is inserted into the housing member, whereby the conductive terminal is inserted into the socket apparatus through the aperture and secured by the securing means.

2. The socket apparatus of claim 1 wherein the socket apparatus is further comprised of a conductive wire that is electrically connected to the conductive contact.

3. The socket apparatus of claim 1 wherein the securing means comprises:

a spring sized to fit within the channel; and a contact pressure slide that is attached to the spring, the contact pressure slide moving in response to contact made between it and the conductive terminal that is inserted into the housing member, thereby securing the conductive terminal between the contact pressure slide and the conductive contact.

4. The socket apparatus in claim 3 wherein the socket apparatus further comprises a conductive wire that is electrically connected to the conductive contact.

5. A socket apparatus including:

a housing member with a stepped cavity defining a channel within the housing member;

a spring positioned within the channel;

a conductive contact contained within the housing member;

a lid attached to the housing member, the lid including a guiding tab cantilevered into the channel when the lid is attached to the housing member such that the guiding tab and the channel mutually support the spring within the housing member, wherein one of the housing member and the lid contains an aperture through which a conductive terminal can be inserted into the stepped cavity;

a contact pressure slide contained within the stepped cavity and attached to the spring such that the contact pressure slide moves transversely within the stepped cavity, in response to contact made between the contact pressure slide and the conductive terminal inserted through the aperture and into the housing member, wherein a distance between the contact pressure slide and the conductive contact accommodates the inserted conductive terminal; and a conductive wire that is attached to the conductive contact, whereby the conductive terminal can be inserted into or removed from the socket apparatus thereby securing the conductive terminal within the socket apparatus and electrically connecting the conductive terminal as desired via the conductive contact and conductive wire.

6. The socket apparatus of claim 5 wherein one end of the conductive wire is attached to the conductive contact and the other end is located outside the housing member.

7. A socket apparatus including:

a housing member that has a surface upon which is carried at least one recess wherein the recess' boundary within the housing member is formed by a base and an inside wall spanning from the recess' perimeter on the surface to the base's perimeter;

a spring positioned entirely within the recess such that one end of the spring is supported by the inside wall;

a conductive contact positioned entirely within the recess and supported by the inside wall;

a lid carrying at least one tab that fits into the recess thereby securing the lid to the housing member's surface and supporting a side of the spring, wherein one of the housing member and the lid contains an aperture through which conductive terminals of varying diameters can be inserted;

a contact pressure slide positioned entirely within the recess, the contact pressure slide carrying a means by which the spring is attached to the contact pressure slide, so that the spring is compressed between the contact pressure slide and the inside wall, and the contact pressure slide having a beveled surface facing the aperture, such that the spring, in response to contact between the beveled surface and one of the conductive terminals, when the conductive terminal traverses the lid's aperture into the recess, causes the contact pressure slide to move transversely within the recess so that the distance between the contact pressure slide and the conductive contact accommodates the conductive terminal; and a conductive wire that is attached to the conductive contact, whereby the conductive terminal may be inserted into or removed from the socket apparatus, thereby securing the conductive terminal within the socket apparatus and electrically connecting the conductive terminal as desired via the conductive contact and conductive wire.

8. The socket apparatus of claim 7 wherein the housing member is molded.

9. The socket apparatus of claim 7 wherein the surface on the housing member is planar.

10. The socket apparatus of claim 7 wherein the means by which the spring is attached to the contact pressure slide is a centrally located depression on the contact pressure slide.

11. The socket apparatus of claim 7 wherein the contact pressure slide has a front end and a back end which slide against the lid and base, respectively.

12. The socket apparatus of claim 7 wherein one end of the conductive wire is attached to the conductive contact and the other end is located outside the housing member.

13. A socket apparatus including:

a housing member with a recess, the recess being defined by an inside wall and an adjoining base within the housing member;

a spring positioned entirely within the recess such that a top end of the spring is supported by the inside wall;

a conductive contact positioned entirely within the recess and supported by the inside wall;

a lid sized to fit within the recess and to support a side of the top end of the spring, the lid including an aperture through which conductive terminals of varying diameters can be inserted into the recess; and means for securing one of the aforementioned conductive terminals to the conductive contact, the securing means being supported by a second end of the spring, the lid, the inside wall, and the base.

14. The socket apparatus of claim 13 wherein the securing means comprises a contact pressure slide having a beveled surface facing the lid's aperture, such that the spring, in response to contact between the beveled surface and the conductive terminal, causes the contact pressure slide to move transversely within the recess to that the contact pressure slide presses the conductive terminal against the conductive contact.

15. The socket apparatus of claim 13 wherein the socket apparatus is further comprised of a conductive wire that is electrically connected to the conductive contact.

16. A socket apparatus including:

a housing member with a recess, the recess being defined by an inside wall and an adjoining base within the housing member, the inside wall including an aperture through which conductive terminals of varying diameters can be inserted into the recess;

a spring positioned entirely within the recess such that a top end of the spring is supported by the inside wall;

a conductive contact positioned entirely within the recess and supported by the inside wall;

a lid sized to fit within the recess and to support a side of the top end of the spring; and means for securing one of the aforementioned conductive terminals to the conductive contact, the securing means being supported by a second end of the spring, the lid, the inside wall, and the base.

17. The socket apparatus of claim 16 wherein the securing means comprises a contact pressure slide having a beveled surface facing the inside wall's aperture, such that the spring, in response to contact between the beveled surface and the conductive terminal, causes the contact pressure slide to move transversely within the recess so that the contact pressure slide presses the conductive terminal against the conductive contact.

18. The socket apparatus of claim 16 wherein the socket apparatus is further comprised of a conductive wire that is electrically connected to the conductive contact.

* * * * *